United States Patent [19]

Glasauer et al.

[11] 4,412,201

[45] Oct. 25, 1983

[54] COIL FORM AND ASSEMBLY FOR AUTOMATED MANUFACTURING OPERATIONS

[76] Inventors: Rudolf Glasauer, Oberndorfer Str. 28; Bernhard Duschl, Nussbaumstr. 35; Wilhelm Linzmeier, Tannenweg 9; Arnold Schaffrik, Regierungsstr. 545, all of 8300 Landshut, Fed. Rep. of Germany

[21] Appl. No.: 386,726

[22] Filed: Jun. 9, 1982

[30] Foreign Application Priority Data

Jun. 30, 1981 [DE] Fed. Rep. of Germany ..... 3125623

[51] Int. Cl.[3] ..... H01F 15/10

[52] U.S. Cl. ..... 336/192; 336/107

[58] Field of Search ..... 336/192, 208, 198, 107; 310/71

[56] References Cited

U.S. PATENT DOCUMENTS 3,760,339 9/1973 Marshall ..... 336/192 X 3,800,172 3/1974 Artin et al. ..... 336/192 X 4,132,913 1/1979 Lautner et al. ..... 336/192 X

*Primary Examiner*—Thomas J. Kozma

[57] ABSTRACT

A coil assembly, in particular for shaded-pole motors, in which at least one edge of a coil form flange has a molded connecting pocket (typically 4, 5, 6, 7) containing groove (18) by snap-in type of covers (8), with one end of the groove (18) containing a recess (cavity 23) and a blind bore (20). A conductive member connecting sleeve (11) is inserted into the blind bore (20), the sleeve being of tubular construction at its end opposite the blind bore. The sleeve includes a conductive pin (13) projecting at a right angle, and has a narrow (taper) (22) producing a "weak" point (taper) about which the sleeve is bent into the recess. Pin (13) has an end of the winding attached thereto before sleeve 11 is bent, such that the connection is enclosed in the recess. Attachment of a Litz wire (pigtail) is by crimping into the end of the sleeve. The Litz wire lays in the groove and is captured by teeth (14) which bite into its insulation from the inside surface of the cover (8) thereby providing strain relief.

5 Claims, 7 Drawing Figures

Fig.1
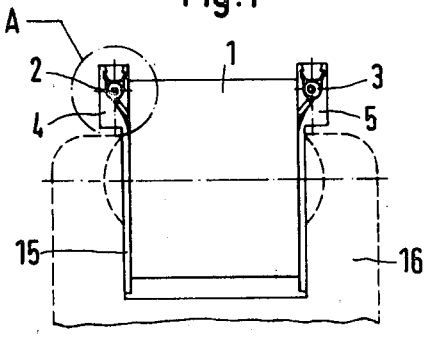
Fig.2
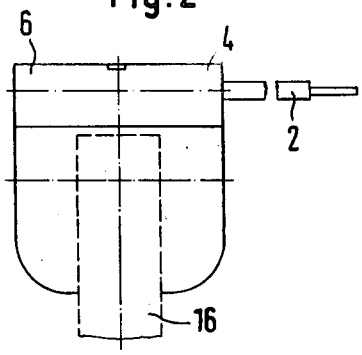
Fig.3
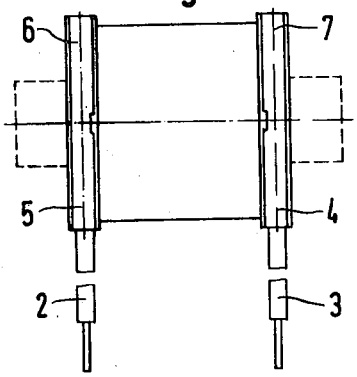
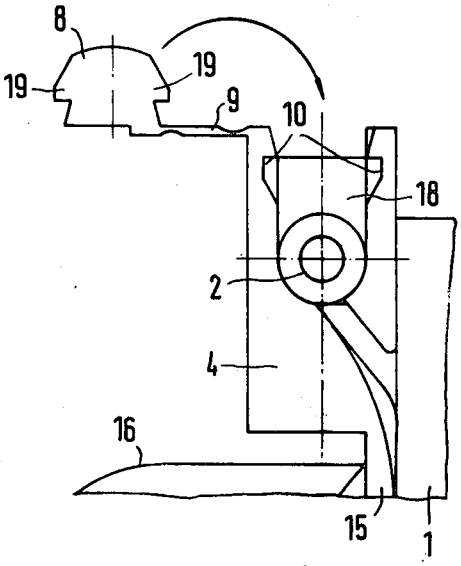
Fig.4

COIL FORM AND ASSEMBLY FOR AUTOMATED MANUFACTURING OPERATIONS

BACKGROUND OF THE INVENTION

1. Field of the Invention

The invention relates generally to electric coil manufacturing tooling and more specifically to coil forms suitable for being used with electric devices, such as reactance coils, motors, or the like.

2. Description of the Prior Art

Owing to the increased automation employed in the manufacture of coils, such as reactance coils, stator coils of motors, and the like, which are wound on coil forms, it has become economically important to be able to perform certain operations over and above mere coil winding, which hitherto have been carried out manually, on an automatic machine, preferably on the same automatic machine producing the winding. These operations, for example, include the attaching of connecting Litz wires to the winding ends and also stress-relieving of these connecting Litz wires.

Applicants' earlier German specification DE-OS No. 23 26 090 discloses a coil form designed in such a way that both the winding of the coil and the attaching of the connecting Litz wires can be carried out automatically. This conventional type of coil form, however, has been found to have shortcomings.

SUMMARY OF THE INVENTION

It is the general object of the invention to provide an improved coil assembly including a unique coil form compatible with an automatic machine for manufacturing a substantially complete electric coil.

According to the invention, this general object is achieved by a unique structure including a molded connecting pocket molded to the coil form flange and comprising a groove closed by a snap-in type cover, with the one end thereof containing a recess and a blind bore, this bore receiving a connecting sleeve. This sleeve at its end opposite the blind bore is of tubular design and comprises a connecting pin projecting at a right angle, and having a taper, with a recess communicating with the winding space via a slot.

The detailed description following will serve to describe preferred embodiments of the invention in detail.

BRIEF DESCRIPTION OF THE DRAWINGS

FIGS. 1, 2 and 3 are different views of an electric device employing the coil form of the invention assembled to a bundle of laminations.

FIG. 4 shows the detail A of FIG. 1 on an enlarged scale.

DESCRIPTION OF THE PREFERRED EMBODIMENT

Figure 6:
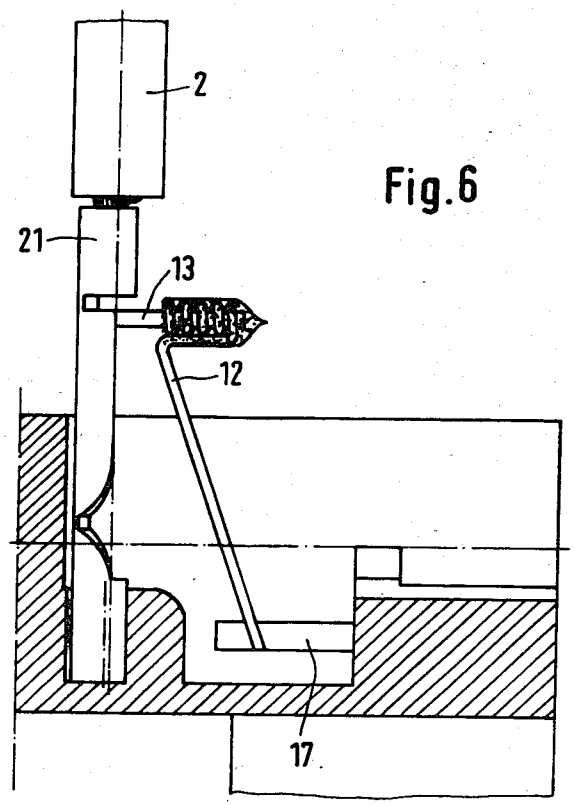
FIGS. 5, 6 and 7 illustrate three successive steps in the manufacturing process using the coil form according to the invention.

FIGS. 1, 2 and 3 show one exemplified embodiment of the invention in which the coil form 15 (of a plastic or other insulating material) on which the shaded-pole motor winding 1 is wound, is arranged on the stator, the latter consisting of a conventional bundle of laminations 16. The winding 1 is of the monofiber type, having one beginning and one end each provided with a terminal (Litz) wire (2 and 3), for external connection. The connections between the winding 1 and the terminal Litz wires 2, 3 are protected to avoid electric shock hazards, and are arranged in a stress-relieved manner in the connecting pockets 4 and 5. As can be seen from FIG. 3, four such connecting pockets may be discretely arranged on the same side of the coil form, in corresponding connecting pockets 4, 5, 6 and 7.

FIG. 4 shows a detail A of FIG. 1 on an enlarged scale. From this illustration it can be recognized that the coil form 15 is provided with a slot 17 between the winding space and the connecting pocket 4 through which one end of the winding is led into a corresponding connecting pocket. Moreover, it can be seen from FIG. 4 how the terminal Litz wire 2, which is connected to one end of the winding, is arranged in the groove 18 of the connecting pocket 4. The connecting pocket 4 is closed by a cover 8 with the barbs 19 thereof engaging behind the undercuttings 10. In the example shown in FIG. 4, the cover 8 is connected to the connecting pocket 4 by way of a film hinge 9. The cover 8, however, may also be manufactured individually and, during the assembly, may be supplied either individually or as a reel-packed component.

Figure 5:
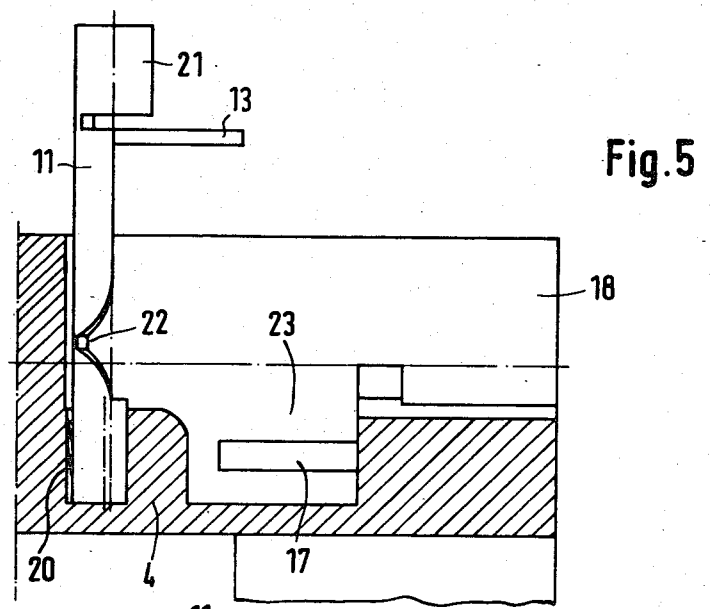
Figure 7:
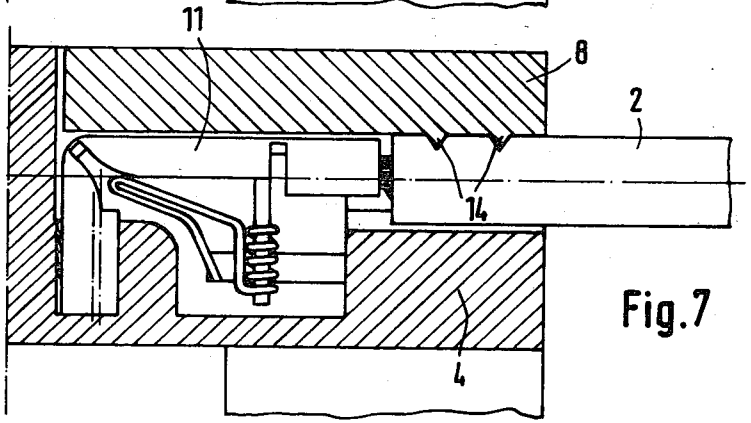

FIG. 5 shows connecting pocket 4 prior to the connection of the wire end of the winding and the corresponding terminal Litz wire. The views as shown in FIGS. 5, 6 and 7 correspond to a longitudinal section taken through the upper, right-hand half of FIG. 2. In FIG. 5, the connecting sleeve 11 is shown to be inserted into the blind bore 20. This connecting sleeve 11 is provided, at its upper end, with a tubular member 21 and the connecting pin 13. In its lower part, the connecting sleeve is provided with a taper 22 representing a defined bending point. The reference numeral 23 indicates a recess in the groove 18.

FIG. 6 shows that one end 12 of the winding has been led through the slot 17 to the connecting pin 13 which, in this particular case, serves as a wire-wrap post on which the wire is wrapped and dip-soldered or welded. The terminal Litz wire 2 has been in such a way connected to the connecting sleeve 11 that its stripped end has been inserted into the tubular member and fixed, for example, by way of crimping. In lieu of that connection, however, it is of course also possible to provide a plug-in connection.

FIG. 7 shows the terminal Litz wire connection in the assembled device. The connecting sleeve 11 has been bent by about 90° in the course of which the wire-wrap post together with the end 12 of the winding as wrapped thereon has been entered into the recess 23. The terminal Litz wire 2 is positioned in the groove 18 which is closed by the cover 8. The projections (teeth) 14 cut into the insulating sheathing of the terminal Litz wire and thereby anchor the Litz wire to provide strain-relief.

The so-called taper 22 is a "necking-in" or reduction in the cross-section of sleeve member 11 to produce a weak point at which the member bends to the position shown in FIG. 7.

The automatic machine for effecting the operations described may be a modified winding machine with attachments for wrapping, winding and soldering or welding wire 12 around post 13, crimping the Litz wire 2 into portion 21 of the sleeve member 13 and for bending the member 13 as shown in FIG. 7.

The sleeve member 11 is affixed in a blind bore 20, but may be molded into the pocket structure 4 at the outset rather than being subsequently placed in the bore. The pocket structure 4 may be fabricated integrally with the spool-shaped winding form with flanges 15. Suitably soft insulating plastic materials are known in the art which lend themselves to integral molding operations whereby the structural parts shown and described may all be integrally fabricated. This allows for snap-in of the cover 8 by deformation of the parts until the barbs 19 are secured behind the undercuttings 10. Film hinge 9 bends and folds over to the necessary extent during insertion of cover 8.

What is claimed is:

1. A coil assembly having a winding for electric devices such as inductive reactors, motors and the like, and adapted for manufacture by automatic machinery, comprising:

a spool-like form of insulating material for receiving and supporting said winding, said form having flanges;

first means affixed to an edge of at least one of said flanges, said first means including a pocket structure having a groove elongated in a generally tangential direction, said pocket structure including a snap-in cover;

a recess enlarging said groove over a first distance from a first end of said groove thereby forming a recess having an opening through the corresponding flange with one end of said winding passing therethrough;

second means comprising a conductive sleeve member affixed adjacent to said groove first end and initially extending normally with respect to said groove direction of elongation, said sleeve member also including a conductive pin extending normal to said sleeve member, said one end of said winding connecting to said pin;

a taper producing a bending point in said sleeve member such that said member is bent into said recess thereby providing folding of the conductor of said one end of said winding into said recess;

a Litz wire affixed into the free end of said sleeve member, said Litz wire assuming a lay-in position in said groove when said sleeve member is bent into said recess;

and third means associated with the inside surface of said cover to grip said Litz wire thereby providing relief against strain from external forces applied to said Litz wire.

2. Apparatus according to claim 1 in which said cover and said pocket structure are fabricated from relatively soft plastic insulating material.

3. Apparatus according to claim 1 in which said cover includes outwardly extending barbs running generally parallel to the elongated sides of said pocket structure within said groove and said groove includes undercuttings for engaging said barbs and holding said cover tightly in place.

4. Apparatus according to claims 1, 2 or 3 in which said third means comprises at least one tooth projecting from the inside surface of said cover to bite into the insulation of said Litz wire.

5. Apparatus according to claims 1, 2 or 3 in which a fiber hinge is integrally molded into an edge of said pocket structure and said cover to captivate said cover.

* * * * *